US007568955B2

(12) United States Patent
Stoner, Jr. et al.

(10) Patent No.: US 7,568,955 B2
(45) Date of Patent: Aug. 4, 2009

(54) LAMP BASE FOR DUAL-LEG LAMP ASSEMBLY

(75) Inventors: William T. Stoner, Jr., Ada, MI (US); Karlis Vecziedins, Caledonia, MI (US); Michael K. Greene, Ada, MI (US)

(73) Assignee: Access Business Group International LLC, Ada, MI (US)

( * ) Notice: Subject to any disclaimer, the term of this patent is extended or adjusted under 35 U.S.C. 154(b) by 0 days.

(21) Appl. No.: 11/972,966

(22) Filed: Jan. 11, 2008

(65) Prior Publication Data

US 2008/0170399 A1 Jul. 17, 2008

Related U.S. Application Data

(60) Provisional application No. 60/885,083, filed on Jan. 16, 2007.

(51) Int. Cl.
*H01R 24/00* (2006.01)

(52) U.S. Cl. ..... 439/699.2; 439/611; 439/235; 439/247; 439/300; 313/580; 313/318.01

(58) Field of Classification Search ..... 439/247, 439/300, 619, 699.2, 611–612, 235–236; 313/318.01
See application file for complete search history.

(56) References Cited

U.S. PATENT DOCUMENTS 2,004,564 A 6/1935 Bol
2,020,718 A 11/1935 Bol et al.
5,252,890 A 10/1993 Yasuda
5,455,484 A 10/1995 Maya et al.
6,001,351 A * 12/1999 Chokri et al. ..... 424/93.21
6,005,337 A 12/1999 Papp et al.
6,597,091 B2 * 7/2003 Choi ..... 313/318.01
6,971,917 B2 * 12/2005 Faust et al. ..... 439/619
7,025,634 B1 * 4/2006 Swantner et al. ..... 439/619

FOREIGN PATENT DOCUMENTS

DE 19857721 A1 6/1999
JP 04039834 2/1992

OTHER PUBLICATIONS

International Search Report and the Written Opinion of the International Searching Authority, mailed Sep. 18, 2008.

* cited by examiner

*Primary Examiner*—Truc T Nguyen
(74) *Attorney, Agent, or Firm*—Warner Norcross & Judd LLP

(57) ABSTRACT

A lamp base for a dual-leg lamp is provided with at least one oversized leg mounting hole that permits relative movement of the lamp legs during temperature driven expansion and contraction. In one embodiment, only one leg of the lamp is glued to the lamp base. The absence of glue on one leg permits essentially free movement of the non-glued leg with respect to the base. In those embodiments that include only a single oversized leg mounting hole, the leg disposed within the oversized leg mounting hole is not glued so that the leg is free to move within the oversized hole. In those embodiments in which both leg mounting holes are oversized, it is acceptable for either (or both) of the legs to be non-glued.

15 Claims, 7 Drawing Sheets

LAMP BASE FOR DUAL-LEG LAMP ASSEMBLY

BACKGROUND OF THE INVENTION

The present invention relates to lamp bases for use with lamp assemblies, and more particularly to a lamp base for use with a lamp having dual legs.

A variety of gas discharge lamp assemblies are available in a dual-leg construction, including both UV and fluorescent lamps. A dual-leg construction is relatively compact and therefore provides a number of benefits over conventional single tube lamp assemblies. A conventional dual-leg lamp includes a pair of side-by-side legs that are interconnected by a bridge. The bridge is essentially a small hollow tube that joins and provides internal communication between the two legs. An electrode is mounted to the end of each leg. The hollow bridge allows electricity to flow from one electrode to the other to complete the electrical path required to operate the lamp. The legs and bridge are typically integrally formed from glass, quartz or other appropriate transparent materials. In many applications, the end of the lamp containing the electrodes is mounted to a lamp base. The lamp base supports the lamp and provides an electrical plug for connecting the lamp assembly to a source of power. Typically, both legs of the lamp are glued to the base to provide a strong and durable assembly. For example, one prior art lamp assembly 200 is shown in FIGS. 1-2. The illustrated prior art lamp assembly 200 generally includes a lamp 202, a lamp base 204 and an end cap 206 (See FIG. 1). The lamp 202 includes two legs 208 and 210 that are joined by bridge 212. The electrode ends of each leg 208 and 210 are received within the lamp base 204. The lamp base 204 defines a pair of mounting holes 214 and 216 that are configured to closely receive the legs 208 and 210, respectively (See FIGS. 2A-2D). In the illustrated assembly, the legs 208 and 210 are largely circular in cross section. Similarly, the mounting holes 214 and 216 are also largely circular cross section, each having a diameter slightly larger than the outer diameter of the corresponding leg 208 and 210. FIG. 2 shows the prior art lamp assembly 200 with the end cap 206 removed. As can be seen in FIG. 2D, in one embodiment, both legs 208 and 210 are surrounded by glue 218 that secures the legs 208 and 210 to the base. The glue 218 and close interfitting relationship between the mounting holes 214 and 216 and the legs 208 and 210 essentially precludes movement of the legs 208 and 210 with respect to one another.

Experience has revealed that dual-leg lamps, although quite reliable, have been known to fail during operation as a result of fractures, cracks or other breaks in the bridge. Accordingly, there is a desire for a lamp assembly that addresses this issue.

SUMMARY OF THE INVENTION

The aforementioned problems are overcome by the present invention wherein a lamp base for a dual-leg lamp is provided with at least one oversized leg mounting hole that permits relative movement of the lamp legs during temperature driven expansion and contraction. The oversized leg mounting hole provides clearance for the contained leg to move in a direction parallel to the longitudinal direction of the bridge. In use, the oversized hole permits relative movement between the two legs of the lamp during expansion and contraction of the lamp that occurs as the lamp is heated and cooled.

In one embodiment, the legs of the lamp are essentially circular in cross section and the lamp base defines an oblong leg mounting hole that is elongated in a direction parallel to the longitudinal extent of the bridge. If desired, both leg mounting holes may be oblong. The degree to which the hole is elongated is selected to provide ample clearance for the leg to move unimpeded through heat-related expansion and contraction of the lamp.

In one embodiment, only one leg of the lamp is glued to the lamp base. The absence of glue on one leg permits essentially free movement of the non-glued leg with respect to the base. In those embodiments that include only a single oversized leg mounting hole, the leg disposed within the oversized leg mounting hole is not glued so that the leg is free to move within the oversized hole. In those embodiments in which both leg mounting holes are oversized, it is acceptable for either (or both) of the legs to be non-glued.

In one embodiment, the lamp base includes a divider positioned between the two leg mounting holes to hold glue on one side of the base. In use, the divider prevents glue applied to one leg of the lamp from flowing onto the opposite leg, and thereby helps to ensure that at least one leg of the lamp is free to move with respect to the base.

The present invention provides a simple and effective lamp base that dramatically reduces the risk of damage to the bridge of dual-leg lamps assemblies. As a result of the oversized leg mounting hole, the base does not prevent the legs from moving during thermal expansion and contraction of the lamp. Further, the absence of glue from one leg, allows that legs to move freely. The ability of at least one leg to be able to move in concert with thermal expansion and contraction reduces undesirable stress and other forces on the bridge that could result with conventional lamp bases that hold both legs of the lamp in a fixed position.

These and other objects, advantages, and features of the invention will be readily understood and appreciated by reference to the detailed description of the current embodiment and the drawings.

DESCRIPTION OF THE CURRENT EMBODIMENT

Figure 5:
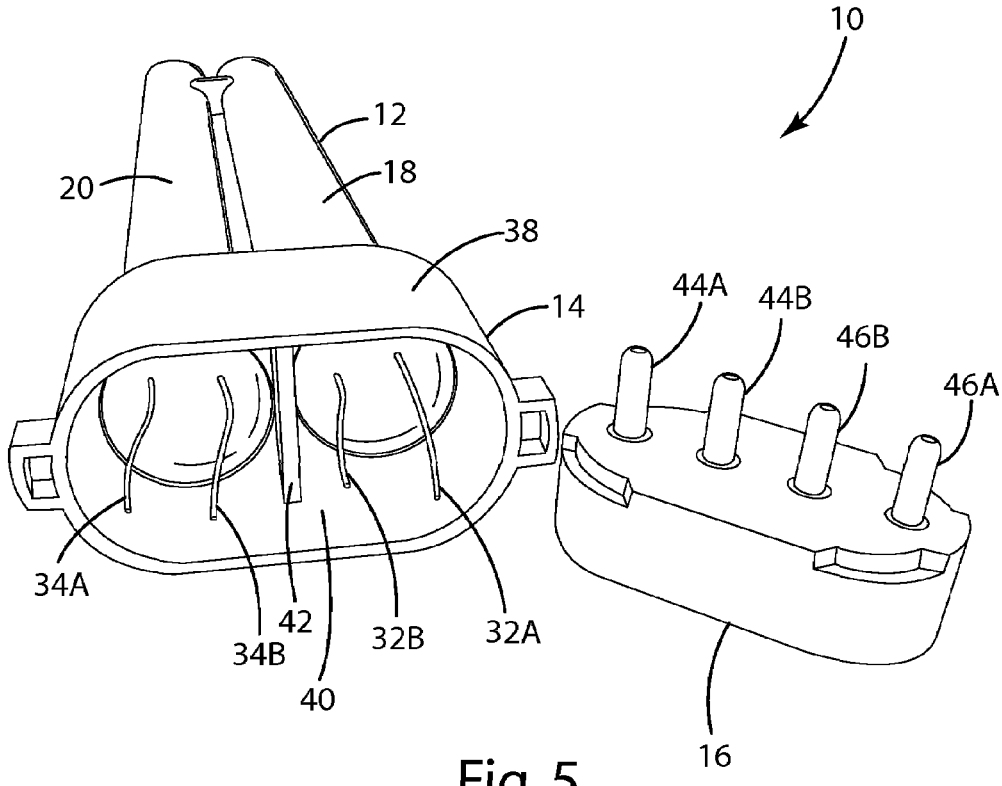
FIG. 5 is a bottom perspective view of a dual-leg lamp assembly and the end cap.

A lamp assembly in accordance with an embodiment of the present invention is shown in FIG. 5 and generally designated 10. The lamp assembly 10 generally includes a dual-leg lamp 12, lamp base 14 and an end cap 16. The dual-leg lamp includes two legs 18 and 20 that are both mounted within the lamp base 14. The lamp base 14 defines a pair of oversized holes 22 and 24 that receive the legs 18 and 20 of the lamp 12. In the illustrated embodiment, only one leg 18 is glued to the lamp base 14. The oversized holes 22 and 24 and absence of glue on one leg 20 permit the lamp 12 to undergo thermal expansion and contraction. Although described in connection with a conventional dual-leg lamp assembly, the present invention is well suited for use with essentially any lamp having multiple legs and a bridge.

The present invention is described in connection with lamp assembly 10, which is a largely conventional lamp assembly. As noted above, the lamp assembly 10 generally includes a lamp 12, a lamp base 14 and an end cap 16. The lamp 12 is a generally conventional dual-leg UV lamp. As a result, the lamp 12 will not be described in detail. Suffice it to say that the lamp 12 includes two legs 18 and 20 that are interconnected by bridge 26. In one embodiment, the legs 18 and 20 of the lamp are generally parallel, and the bridge extends approximately perpendicularly between them. The bridge 26 is hollow, thereby providing communication between the interiors of the legs 18 and 20. The lamp 12 further includes a pair of electrodes 28-30—one mounted within each leg 18 and 20. Electrical leads 32*a-b* and 34*a-b* extend from the electrodes 28-30 to the exterior of the lamp 12. The electrical leads 32*a-b* and 34*a-b* are connected to the end cap 16, as described in more detail below.

Figure 1C:
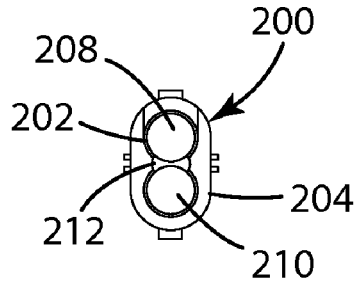
Fig. 1C (Prior Art)
FIG. 1C is a top view of a prior art dual-leg lamp assembly.
Figure 1A:
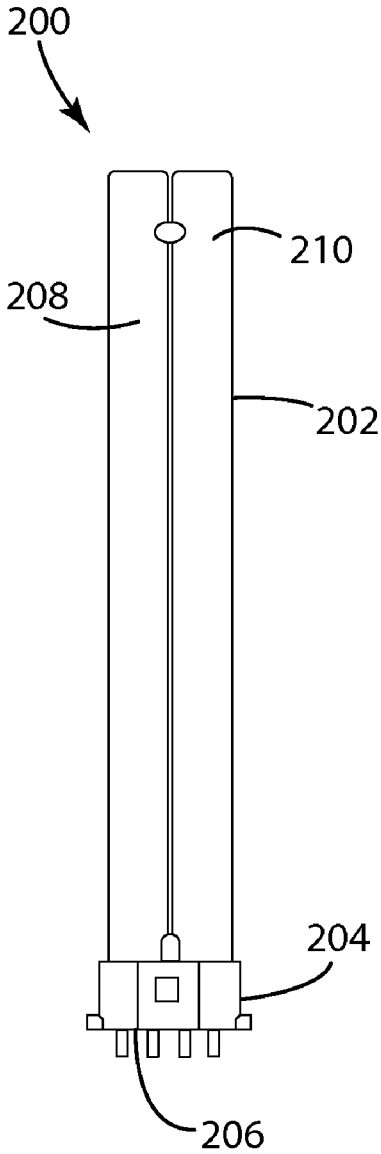
Fig. 1A (Prior Art)
FIG. 1A is a front view of a prior art dual-leg lamp assembly.
Figure 1B:
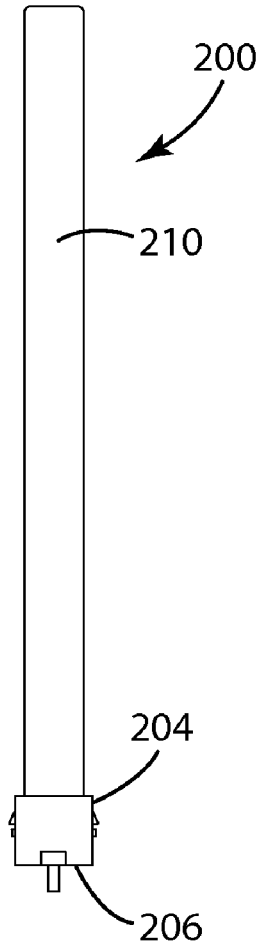
Fig. 1B (Prior Art)
FIG. 1B is a right side elevational view of a prior art dual-leg lamp assembly.
Figure 2A:
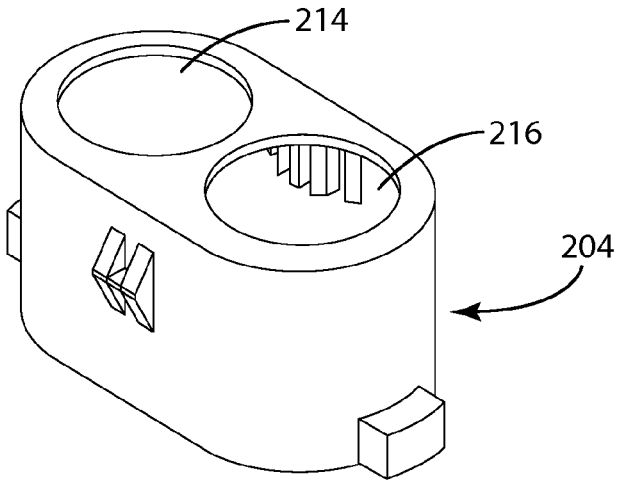
Fig. 2A (Prior Art)
FIG. 2A is a top perspective view of a prior art lamp base.
Figure 2B:
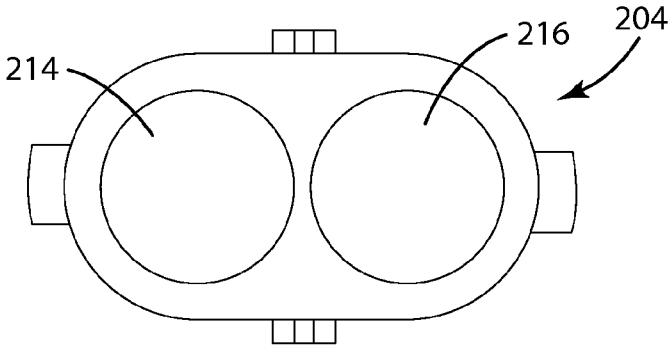
Fig. 2B (Prior Art)
FIG. 2B is a top plan view of the prior art lamp base.
Figure 2C:
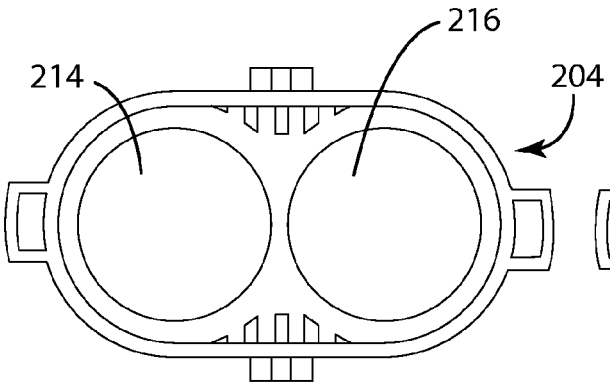
Fig. 2C (Prior Art)
FIG. 2C is a bottom plan view of the prior art lamp base.
Figure 2D:
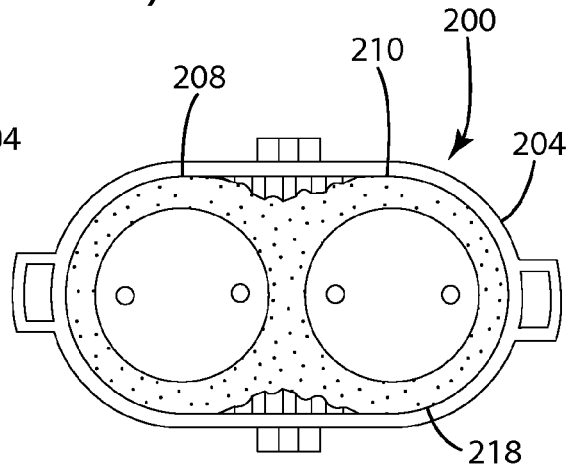
Fig. 2D (Prior Art)
FIG. 2D is a bottom plan view of the prior art dual-leg lamp assembly with the end cap removed to show the lamp glued to the lamp base.
Figure 3A:
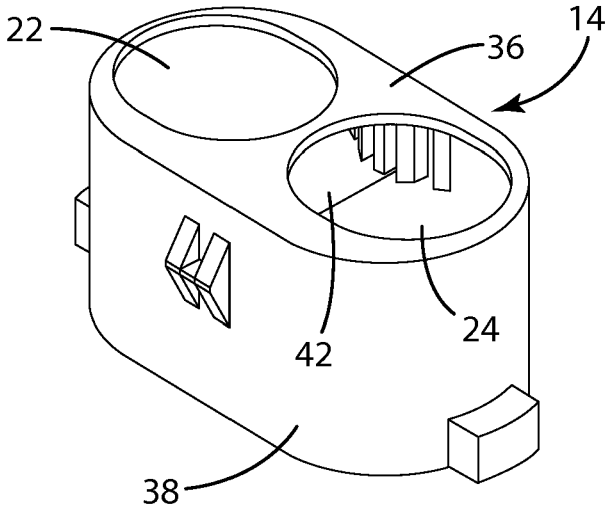
FIG. 3A is a top perspective view of a lamp base according to one embodiment of the present invention.
Figure 3B:
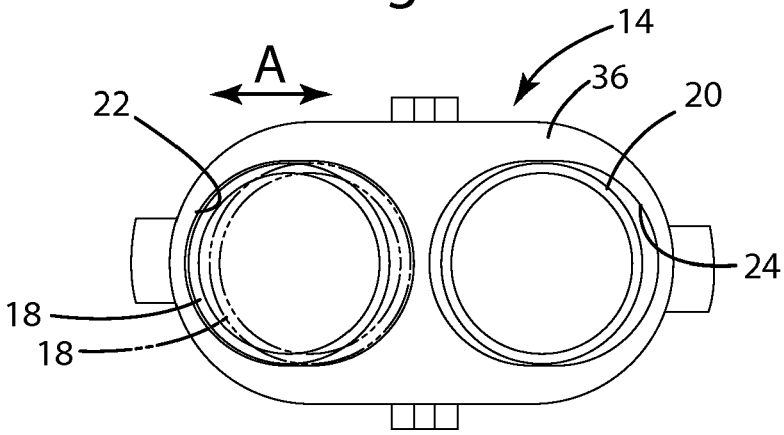
FIG. 3B is a top plan view of the lamp base of the one embodiment, showing one of the lamp legs in a moved position in phantom lines.
Figure 3C:
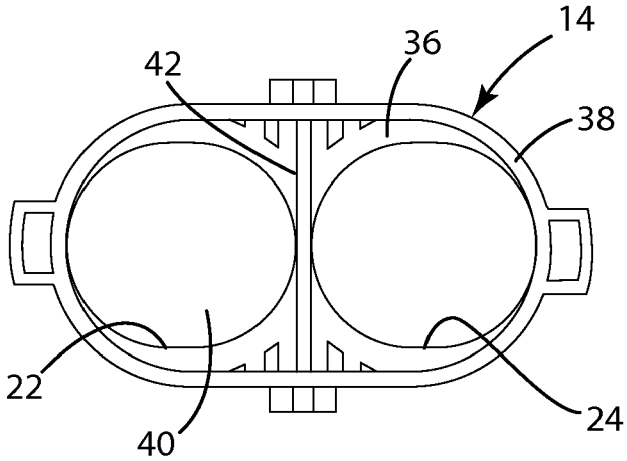
FIG. 3C a bottom plan view of the lamp base of the one embodiment.
Figure 4:
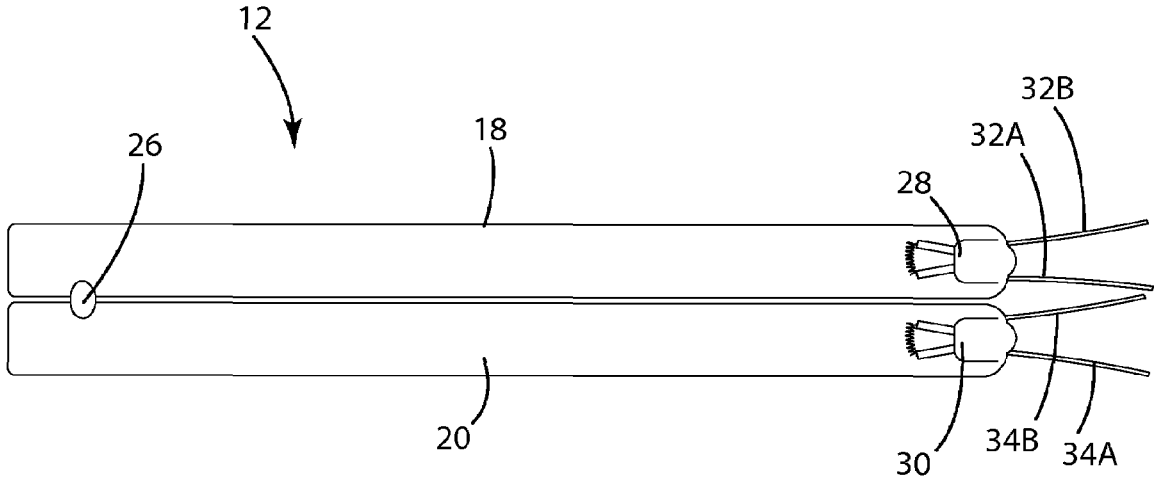
FIG. 4 is a front plan view of a dual-leg lamp.
Figure 6:
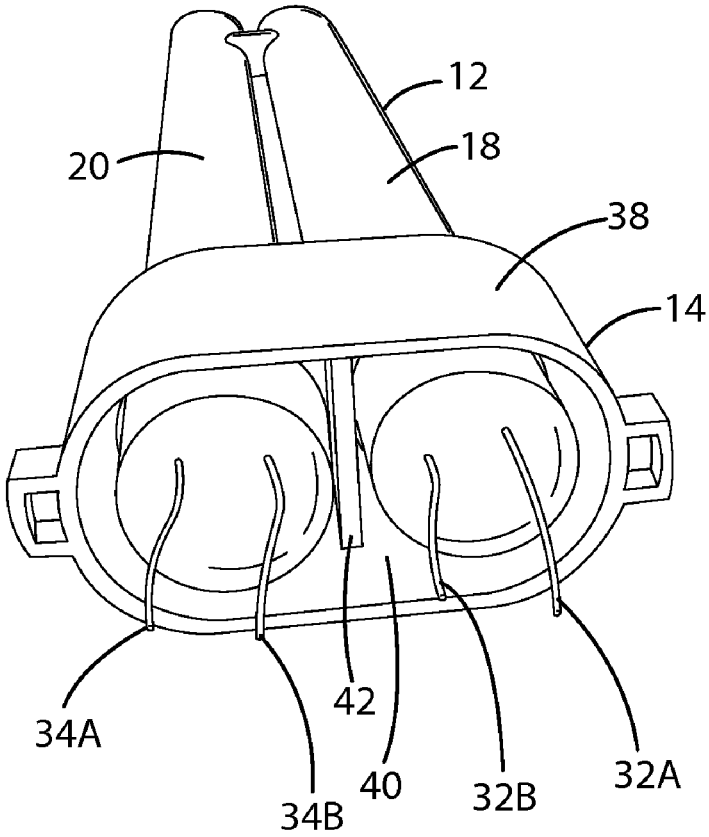
FIG. 6 is a bottom perspective view of a dual-leg lamp assembly with the end cap removed.

As noted above, the lamp 12 is mounted to the lamp base 14. The lamp base 14 is typically configured to fit within a lamp receptacle (not shown) and, if desired, may include mounting tabs and/or other structure to assist in alignment, interfitting and/or interlocking of the lamp base 14 with the lamp receptacle. Accordingly, the design and configuration of the lamp base may vary from application to application as desired to correspond with the intended lamp receptacle. As perhaps best shown in FIGS. 3A-C, the lamp base 14 generally includes a top wall 36 and a side wall 38 extending downwardly from the periphery of the main wall 36. The top wall 36 and side wall 38 cooperatively define an internal space 40 of sufficient size to receive the ends of the legs lamp 12. Directional terms used in association with the lamp base 14, such as "top" and "downwardly," are based on the orientation of the lamp base 14 shown in FIG. 3A. These terms are used as expedients and not intended to limit the present invention to any specific orientation. The lamp base 14 of the illustrated embodiment also includes a divider wall 42 that is disposed within the internal space 40 to provide a degree of separation between the space surrounding each of the legs 18 and 20. The divider wall 42 provides a separator that prevents glue applied to one leg from flowing onto the other leg (see FIG. 7). This facilitates the application of glue to only one of the legs 18 and 20. The leg mounting holes 22 and 24 are defined in the top wall 36. As perhaps best shown in FIGS. 6 and 7, the legs 18 and 20 of the lamp 12 are fitted into leg mounting holes 22. Referring now to FIGS. 3A-C, the leg mounting holes 22 and 24 are oversized in the direction denoted by reference line A in FIG. 3B. This allows for movement of at least one leg 18 and 20 within its corresponding hole 22 and 24. Although the mounting holes may be oversized in essentially any way that permits the desired leg 18 and 20 movement, the mounting holes 22 and 24 of the illustrated embodiment are generally elliptical and are elongated in the direction denoted by reference line A in FIG. 3B. The elongated mounting holes 22 and 24 permit the generally circular legs 18 and 20 to movement within the mounting holes 22 and 24. FIG. 3B shows leg 18 in mounting hole 22 in a first position in solid lines and in a second position in phantom lines. The change in position illustrated in FIG. 3B provides a representation of the range of motion of the legs 18 and 20 within the mounting holes 22 and 24. FIGS. 8-11 show a somewhat different mounting hole shape than shown in FIGS. 3A-C. As illustrated, the mounting holes 22 and 24 of FIGS. 8-11 are more irregular shaped than those of FIGS. 3A-C. In both cases, the mounting holes 22 and 24 are oversized (e.g. larger than the corresponding lamp leg 18 and 20) in the direction denoted by arrow A to provide sufficient clearance for the legs 18 and 20 to move as the lamp 12 undergoes thermal expansion and contraction. Although the lamp base 14 of the illustrated embodiment defines two oversized mounting holes 22 and 24, in some applications only one of the mounting holes need be elongated or otherwise oversized.

Figure 7:
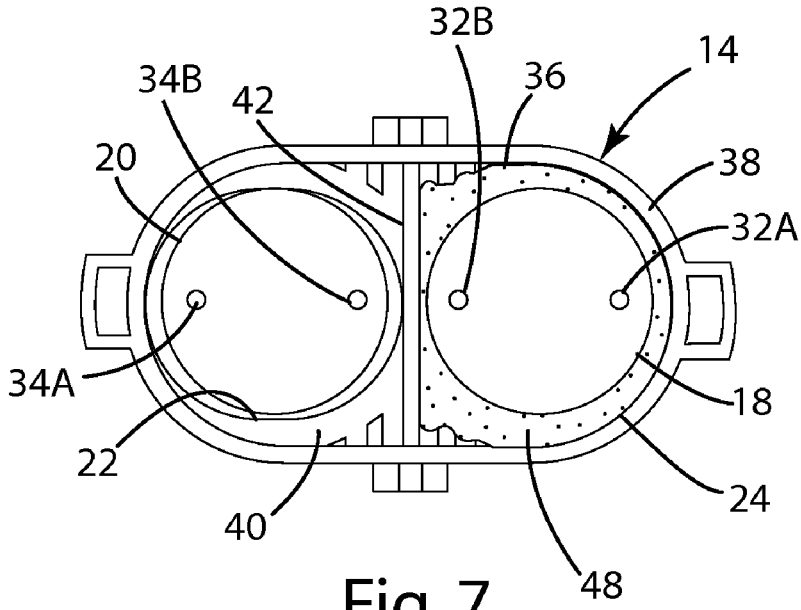
FIG. 7 is a bottom plan view of the lamp assembly according to the one embodiment.
Figure 8:
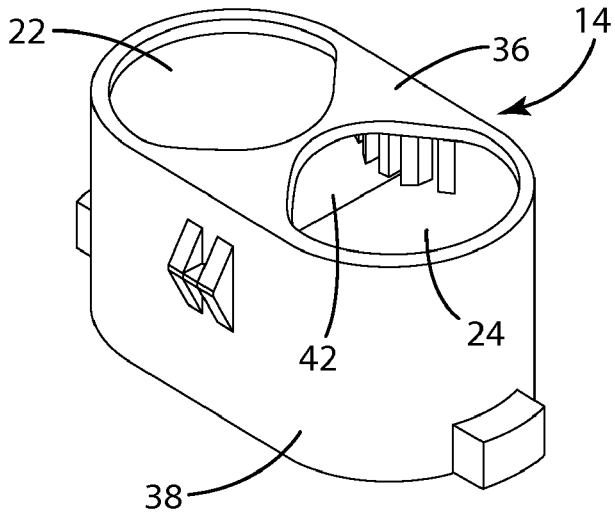
FIG. 8 is a top perspective view of a lamp base according to a second embodiment.
Figure 9:
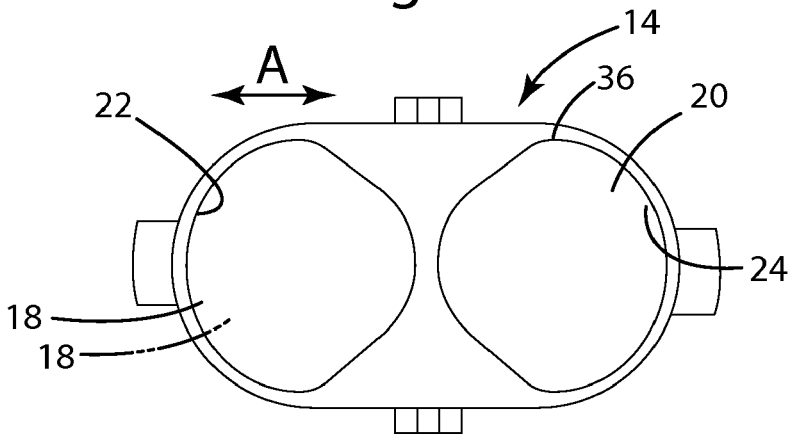
FIG. 9 is a top plan view of a lamp base according to the second embodiment.
Figure 10:
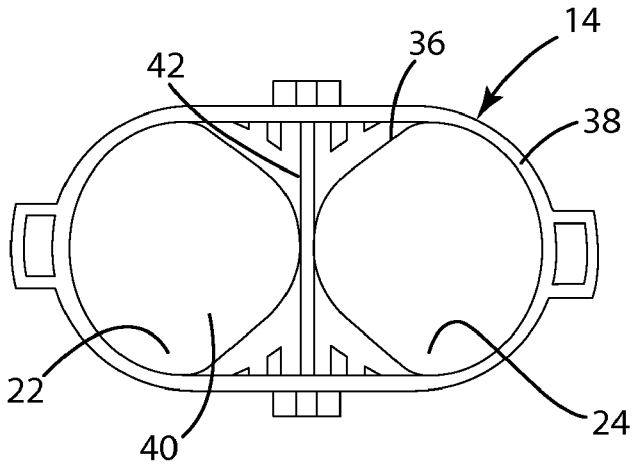
FIG. 10 is a bottom plan view of the lamp base according to the second embodiment.
Figure 11:
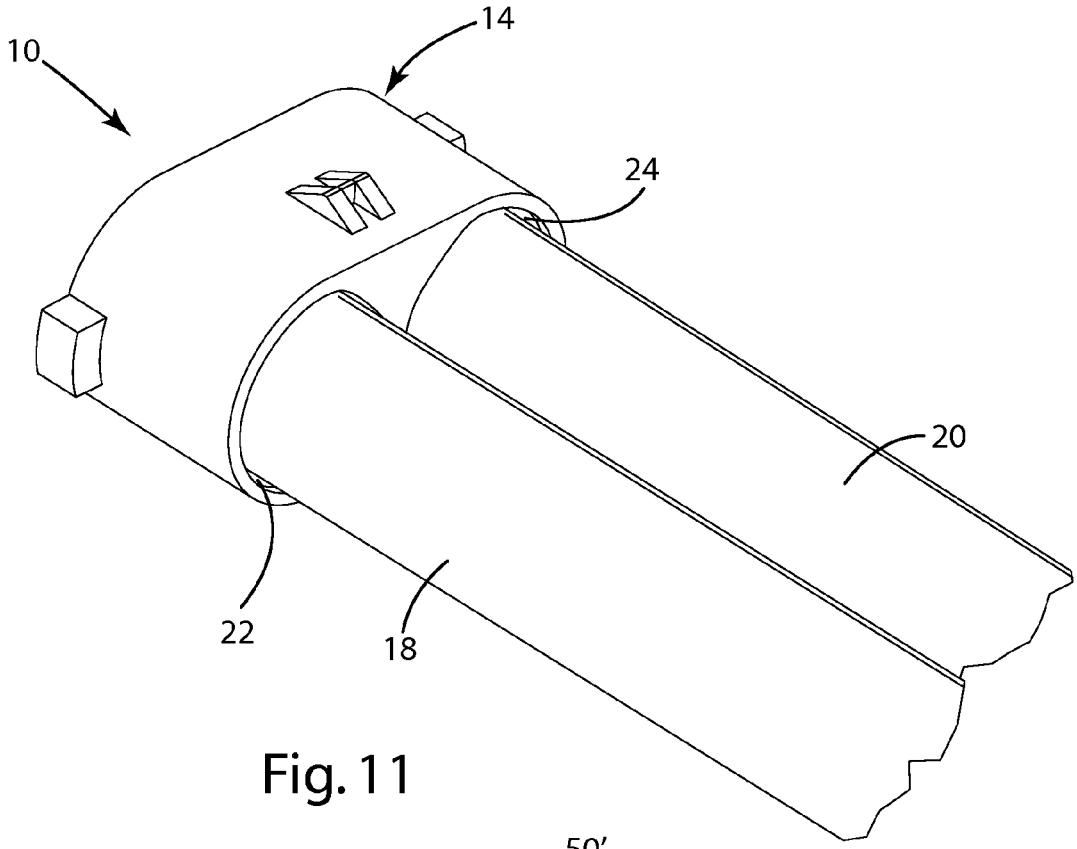
FIG. 11 is a partial front perspective view of the lamp base and a dual-leg lamp according to the second embodiment.

The legs 18 and 20 may be secured to the lamp base 12. In the illustrated embodiment, only leg 18 is secured to the lamp base 12 (see FIG. 7). This leaves leg 20 free to move within mounting hole 22 as the lamp undergoes thermal expansion and contraction. As shown in FIG. 7, lamp leg 18 is secured to the lamp base 14 by glue 48. The glue 48 surrounds the leg 18 and interconnects the leg 18 with the lamp base 14. The divider wall 42 helps to retain the glue 48 on one side of the lamp base 14, thereby leaving leg 20 unglued and free to move within mounting hole 22.

The end cap 16 is fitted into the open end of the lamp base 14 (See FIG. 5). The end cap 16 may be glued, welded or otherwise secured to the lamp base 14, as desired. In the illustrated embodiment, the end cap 16 includes two pair of electrical prongs 44*a-b* and 46*a-b* that extend through and protrude from the end cap 16 to provide connectors for electrically connecting the lamp 12 to a power source. For example, the prongs 44*a-b* and 46*a-b* of the illustrated embodiment are configured to be fitted into corresponding sockets (not shown) in the lamp receptacle (not shown). If desired, the size, shape and arrangement of the prongs 44*a-b* and 46*a-b* may be selected to correspond with essentially standard specifications to facilitate compatibility. The leads 32*a-b* and 34*a-b* of the lamp 12 are electrically connected to the prongs 44*a-b* and 464*a-b*, for example, by crimping, soldering or other conventional techniques. As with the lamp base 14, the end cap 16 is typically configured to fit within a lamp receptacle (not shown) and, if desired, may include mounting tabs and/or other structure to assist in alignment, interfitting and/or interlocking of the lamp base 14 with the lamp receptacle. Accordingly, the design and configuration of the end cap 16 may vary from application to application as desired to correspond with the intended lamp receptacle.

The lamp assembly 10 may be assembled in a wide variety of ways. However, for purposes of disclosure, one method of assembly will be described. In one embodiment, the lamp assembly 10 is assembled by obtaining a pre-manufactured dual-leg lamp. Dual-leg lamps are available in a wide variety of styles from a wide variety of manufacturers. The lamp base 14 and end cap 16 may be manufactured from plastic or other suitable materials. For example, the lamp base 14 and end cap 16 may be injection molded from a plastic material capable of withstanding the temperature extremes associated with the particular application. The electrical prongs 44*a-b* and 46*a-b* are fitted into corresponding apertures in the end cap 16. The prongs 44*a-b* and 46*a-b* may be retained by a friction fit or by other techniques, such as fasteners or adhesives.

The lamp 12 is inserted into the lamp base 14. More specifically, the electrode end of each leg 18 and 20 is inserted the appropriate depth into the leg mounting holes 22 and 24. Glue 48 is applied to the lamp base 14 and the leg 18 to intersecure the lamp 12 and the lamp base 14. The glue 48 may be applied by inverting the lamp base 14 such that the top wall 36, side wall 38 and divider wall 42 cooperatively define a "cup" surrounding the leg 18. Glue 48 is injected, poured or otherwise supplied to the cup where it surrounds the leg 18. Once cured, the glue 48 provides the desired bond. A variety of glues may be used to secure the lamp 12 to the lamp base 14. For example, the glue 48 may be an epoxy and a high temperature silicon adhesive.

The end cap 16 is secured to the bottom of the lamp base 14. This closes the interior space 40 and provides the lamp assembly 10 with the desired electrical prongs 44*a-b* and 46*a-b*. As noted above, the leads 32*a-b* and 34*a-b* of the lamp 12 are electrically connected to the prongs 44*a-b* and 464*a-b*, for example, by soldering or other conventional techniques. The end cap 16 may be glued, sonic welded or otherwise interconnected with the lamp base 14. In some applications, it may be desirable to make the electrical connections between the leads 32*a-b* and 34*a-b* and the prongs 44*a-b* and 46*a-b* before gluing the lamp 12 to the lamp base 14. Once the legs 18 and 20 are seated in the lamp base 14, the confines of the lamp base 14 may make it more difficult to make the necessary electrical connections. If the connections are made before glue 48 is applied, they can be made while the lamp end is pushed out from within the lamp base 14, thereby facilitating the process.

In the illustrated embodiment, the lamp 12 is secured to the lamp base 14 using glue 48 applied around leg 18. The lamp 12 may be secured to the lamp base 14 using other connection mechanisms. For example, a retaining clamp (not shown) may be used to secure the lamp 12 to the lamp base 14. In such embodiments, the clamp may be connected to the lamp base 14, for example, by fasteners, or it may be larger than the mounting hole 22 and 24 so that it cannot be pulled out of the lamp base 14 once the end cap 16 is installed.

Figure 13:
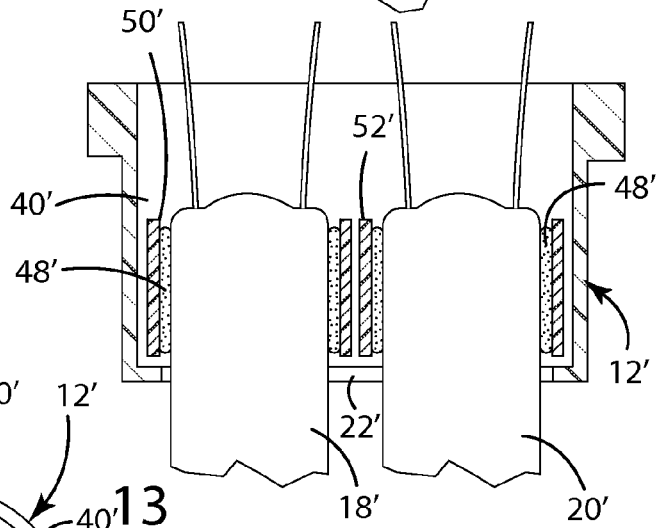
FIG. 13 is a side cross-sectional view of a lamp assembly according to the third embodiment.
Figure 12:
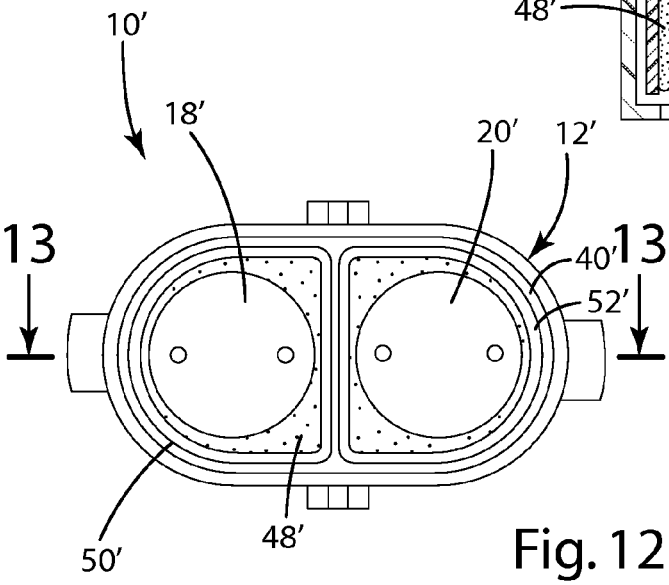
FIG. 12 is a bottom plan view of a lamp assembly according to a third embodiment.

FIGS. 12 and 13 show an alternative lamp assembly 10' in which the legs 18' and 20' of the lamp 12' may be retained within the lamp base 14' by retaining cups 50' and 52'. The retaining cups 50' and 52' are sized and shaped so that at least one of them "floats" within the interior space 40' of the lamp base 14' to allow relative movement of the legs 18' and 20' during thermal expansion and contraction. The retaining cups 50' and 52' float within the lamp base 14' in the sense that they are capable of moving at least in a direction parallel to the longitudinal extent of the bridge to allow movement during thermal expansion and contraction. If desired, this embodiment may be altered so that only one of the retaining cups 50' and 52' floats within the lamp base 14'. The retaining cups 50' and 52' of this embodiment are fitted over the ends of the legs 18' and 20' and secured using glue 48'. They may be secured using alternative techniques, if desired. For example, in some applications, it may be possible to frictionally interfit the retaining cups 50' and 52' to the legs 18' and 20'. In the alternative embodiment of FIGS. 12 and 13, the lamp base 14' may define two separate mounting holes 22 and 24 as described above or the two separate holes 22 and 24 may be replaced by single larger hole 22' that is of sufficient size to receive both legs 18' and 20' and permit the legs 18' and 20' to move relative to one another during thermal expansion and contraction. Although this alternative embodiment shows the use of two separate retaining cups 50' and 52', the present invention may include only one retaining cup in some applications (not shown). In embodiments including only one retaining cup, the retaining cup may be configured to float within the lamp base as described above. However, if the leg that is not connected to the single retaining cup is capable of movement within the lamp base, then the retaining cup may be in a fixed position with respect to the lamp base.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property of privilege is claimed are defined as follows:

1. A lamp assembly comprising:

a lamp having two legs, said legs each having a diameter;

a bridge connecting said legs;

a lamp base defining two leg mounting holes, each of said lamp legs extending into one of said leg mounting holes, one of said leg mounting holes being oversized such that it permits movement within said oversized mounting hole of the one said lamp leg extending through said oversized mounting hole, wherein said one leg is not secured to said lamp base such that it is free to move within said oversized mounting hole and the other of said legs is secured to said lamp base, wherein said oversized leg mounting hole is elongated in only one direction to permit movement of said one leg only in a line extending in said one direction, wherein said one direction is oriented to allow movement of said one leg away from said other leg.

2. The lamp assembly of claim 1 wherein said oversized leg mounting hole is shaped to permit movement of said one of said legs in said oversized leg mounting hole only in a direction parallel to the longitudinal direction of said bridge.

3. The lamp assembly of claim 1 wherein said leg extending into said oversized leg mounting hole is not glued to said lamp base and said other leg is glued to said lamp base.

4. The lamp assembly of claim 3 wherein said lamp base includes a top wall and a side wall extending downwardly from said top wall, said top wall and said side wall cooperating to define an internal space, said leg mounting holes defined in said top wall.

5. The lamp assembly of claim 4 wherein said lamp base includes a divider wall disposed within said internal space, said divider wall positioned between said leg mounting holes to provide a degree of separation between the space surrounding each of said legs.

6. The lamp assembly of claim 5 wherein said oversized leg mounting hole is generally elliptical and is elongated in a direction that permits movement only in a line perpendicular to the other of said legs.

7. A lamp assembly comprising:

a lamp having first and second legs and a bridge, said legs extending generally parallel in a first direction, said bridge extending between said legs and connecting said legs; and a lamp base, said lamp base having a top wall and a side wall extending from said top wall, said top wall defining first and second leg mounting holes, said first lamp leg extending through said first leg mounting hole, said second lamp leg extending through said second leg mounting hole, said second leg secured to said lamp base and not movable with respect to the lamp base, said first leg mounting hole being oversized in relation to said first lamp leg, said first leg not secured to said lamp base to permit movement of said first lamp leg within said first leg mounting hole, wherein said first leg mounting hole is generally elongated in only in one direction, wherein said one direction is oriented to perpendicular to the surface of said second lamp leg to permit movement of said first leg along a line perpendicular to said second lamp leg.

8. The lamp assembly of claim 7 wherein said side wall extends downwardly from said top wall, and wherein said lamp base includes a divider wall extending downwardly from said top wall.

9. The lamp assembly of claim 8 wherein said second leg is glued to said lamp base, said divider wall preventing the glue from contacting said first leg.

10. The lamp assembly of claim 9 including an end cap attached to said sidewall opposite said top wall, said end cap including electrical connectors for connecting said lamp to a power source.

11. The lamp assembly of claim 7 wherein said lamp is a UV lamp.

12. A lamp assembly comprising:

a lamp having two legs and a bridge connecting said legs, said legs each having a diameter and an end, and an electrical contact extending from said end; and a lamp base including a top wall and a side wall extending from the top wall, said top wall and said side wall cooperating to define an internal space, said top wall defining a pair of holes, and each of said legs extending through one of said holes and into said internal space, a first one of said holes being elongated in one direction, and being substantially larger in said one direction than said diameter of the one leg extending therethrough and substantially the same size as said diameter of said one leg in a second direction perpendicular to said one direction, such that said elongated hole permits movement of said one leg with respect to the other leg in said one direction, said one leg not being connected to said lamp base to permit said one leg to move away from the other of said legs, said other of said legs being secured to said lamp base.

13. The lamp assembly of 12 wherein said one of said legs is glued within its hole, and said other of said legs is unglued to permit movement of said leg within its hole.

14. The lamp assembly of claim 13 including an end cap attached to said sidewall opposite said top wall, said end cap including electrical contacts connected to said electrical contacts extending from said lamp legs.

15. The lamp assembly of claim 12 including two retaining cups inside said internal space, each retaining cup receiving one of said lamp leg ends, said retaining cups being collectively smaller than said internal space to permit movement of said lamp legs in relation to each other.

* * * * *